United States Patent [19]

Matsuura et al.

[11] Patent Number: 4,998,036

[45] Date of Patent: Mar. 5, 1991

[54] METAL VAPOR DISCHARGE LAMP CONTAINING AN ARC TUBE WITH PARTICULAR BULB STRUCTURE

[75] Inventors: Atsushi Matsuura, Yokohama; Kazuo Honda; Hisanori Sano, both of Kanagawa; Shinji Inukai, Yokohama, all of Japan

[73] Assignee: Kabushiki Kaisha Toshiba, Kawasaki, Japan

[21] Appl. No.: 283,917

[22] Filed: Dec. 13, 1988

[30] Foreign Application Priority Data

Dec. 17, 1987 [JP] Japan ..... 62-317557
Feb. 24, 1988 [JP] Japan ..... 63-39595

[51] Int. Cl.[5] ..... H01J 61/04

[52] U.S. Cl. ..... 313/25; 313/621; 313/623; 313/631

[58] Field of Search ..... 313/25, 621, 623, 631

[56] References Cited

U.S. PATENT DOCUMENTS

| | | | |
|---|---|---|---|
| 4,612,000 | 9/1986 | English et al. | 445/6 |
| 4,633,136 | 12/1986 | Fromm et al. | 313/623 |
| 4,717,852 | 1/1988 | Dobrusskin et al. | 313/25 |
| 4,739,220 | 4/1988 | Dobrusskia et al. | 313/623 |
| 4,766,348 | 8/1988 | English et al. | 313/631 |

FOREIGN PATENT DOCUMENTS

| | | |
|---|---|---|
| 0128553 | 12/1984 | European Pat. Off. . |
| 0156384 | 10/1985 | European Pat. Off. . |
| 0213927 | 3/1987 | European Pat. Off. . |
| 2402422 | 3/1978 | Fed. Rep. of Germany . |
| 3532207A1 | 3/1984 | Fed. Rep. of Germany . |
| 242736 | 2/1987 | Fed. Rep. of Germany . |
| 3537872A1 | 4/1987 | Fed. Rep. of Germany . |
| 3640990A1 | 6/1988 | Fed. Rep. of Germany . |
| 232662 | 11/1985 | Japan . |
| 2072411 | 9/1981 | United Kingdom . |
| 2126415 | 3/1984 | United Kingdom . |
| 2206992 | 1/1989 | United Kingdom . |

*Primary Examiner*—Donald J. Yusko
*Assistant Examiner*—Michael Horabik
*Attorney, Agent, or Firm*—Cushman, Darby & Cushman

[57] ABSTRACT

A single end-sealed type metal vapor discharge lamp includes an arc tube having a bulb made up of a discharge portion defining a discharge region and a sealing portion with a shoulder portion situated adjacent to the discharge portion. A pair of electrodes have a pair of mutually opposite electrode portions on an upper end of each of the pair, the electrodes extending from the sealing portion toward the discharge region. An outer tube encloses the arc tube in which a cross-sectional configuration of the bulb has a point of inflection at a boundary between the discharge portion and the sealing portion. A straight line l connecting a center of one electrode portion to that of the other electrode potion makes an angle of 15°–45° with respect to a straight line L connecting the point of inflection to a midpoint of the straight line l. The shoulder portion is located at a side opposite to that, on which the straight line l exists with the straight line L as a reference.

9 Claims, 2 Drawing Sheets

METAL VAPOR DISCHARGE LAMP CONTAINING AN ARC TUBE WITH PARTICULAR BULB STRUCTURE

BACKGROUND OF THE INVENTION

1. Field of the Invention

The present invention relates to a single sidesealing type metal vapor discharge lamp and, in particular, a single side-sealed type miniature metal halide lamp.

2. Description of the Related Art

Conventionally, high intensity-discharge lamps have been employed for outdoor illumination and factory illumination, but they begin to be employed for indoor illumination for a low-ceiling establishment, such as shops. Of the high intensity-discharge lamps, a metal halide lamp, in particular, is often used, in a miniature form, in the aforementioned field of application in view of its high luminous efficacy and high color rendition. In order to miniaturize high intensity lamps, single end-sealed type quartz double tube lamps are now in development because it has been difficult to attain the aforementioned purpose with the use of both end-sealed bulb structure.

This type of lamp has the advantages in that it can be miniaturized since its inner and outer tube are sealed at a single end, and it has an excellent heat resistance because of the outer tube also being made of quartz glass.

FIG. 1 is a diagrammatic view showing an arrangement of an arc tube for a single end-sealed metal halide lamp.

In FIG. 1, arc tube's bulb 4 comprises substantially spherical discharge portion 5 defining discharge region 1 and sealing portion 6 located at one side. Bulb 4 contains a rare gas, mercury and metal halide in predetermined quantities for starting. Within discharge region 1, electrodes *7a*, *7b* are located in opposed relation and have their end portions connected to metal foils *8a*, 8b buried in sealing portion 6. Lead wires *9a* and *9b* are connected at one end to metal foils *8a* and *8b*, respectively, and have the other ends associated with an external electrical circuit. Of discharge portion 5, portions *12a* and *12b* which are defined behind electrodes *7a* and *7b* are located adjacent to shoulder portions *6a* and *6b* of sealing portion 6. By incorporating the arc tube within the outer tube of quartz glass it is possible to obtain a metal halide lamp.

When the metal halide lamp is turned ON, an arc is developed across electrodes *7a*, *7b*. In this case, the arc does not face the inner wall of portions *12a* and *12b* and, in comparison with the arc facing portion, the inner wall of portions *12a* and *12b* receives less heat to provide the coolest zone on the inner wall of bulb 4. The coolest zone is further decreased in its temperature due to the absorption of heat by adjacent shoulder portions *6a*, *6b*. This lowers pressure in the arc tube, determined by a temperature at the coolest zone, and thus exerts an adverse effect over the lamp characteristics, such as the luminous efficacy and color rendition.

SUMMARY OF THE INVENTION

It is accordingly the object of the present invention to provide a single end-sealed type metal vapor discharge lamp which prevents a temperature drop at the coolest zone of a bulb and improves lamp characteristics, such as a luminous efficacy and color rendition.

According to the present invention, a single end-sealed metal vapor discharge lamp is provided which comprises an arc tube comprising a bulb made up of a discharge portion defining a discharge region and a sealing portion having a shoulder portion which is situated adjacent to the discharge portion, and a pair of electrodes being such that they have a pair of mutually opposite electrode portions at one end and that they extend from within the sealing portion toward the discharge region; and an outer tube enclosing the arc tube, in which a cross-sectional configuration of the bulb has a point of inflection at a boundary between the discharge portion and the sealing portion, a straight line l connecting a center of the electrode portion to that of the other electrode portion makes an angle of 15° to 45° with respect to a straight line L connecting the point of inflection to a midpoint of the straight line l, and the shoulder portion is located at a side opposite to that, on which the straight line l exists, with the straight line L as a reference.

In the metal vapor discharge lamp thus constructed, the shoulder portion of the arc tube's sealing portion is located in a position away from the coolest zone on the inner surface of the bulb which is located behind the tip portion of the electrode, thus preventing the coolest zone from being further cooled. The loss of heat by the sealing portion can be decreased because it is possible to decrease the whole surface area of the sealing portion. In this way, a pressure drop in the arc tube is prevented from occurring, thus obtaining a metal vapor discharge lamp excellent in its lamp characteristics.

By setting the value of a I(ampere)/d(mm) ratio to satisfy an equation of $2.4 \leqq I/d \leqq 3.27$, the lumen maintenance factor can be enhanced in spite of $W_L$(watt)/S(cm$^2$) as high as 20 to 70, noting that I(ampere) denotes a lamp current when the lamp is lit at a stable level and d(mm) the wire diameter of the electrode, $W_L$(watt) an input power, and S(cm$^2$) an inner surface area of said arc tube. It is thus possible to improve the life of the lamp.

DETAILED DESCRIPTION OF THE PREFERRED EMBODIMENTS

A preferred embodiment of the present invention will be described below in more detail with reference to the accompanying drawings.

Figure 1:
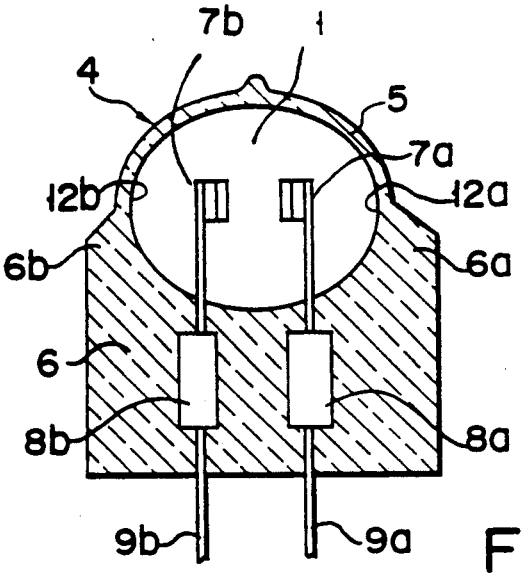
FIG. 1 PRIOR ART
FIG. 1 is a cross-sectional view showing a conventional single end-sealed type miniature metal halide lamp.
Figure 2:
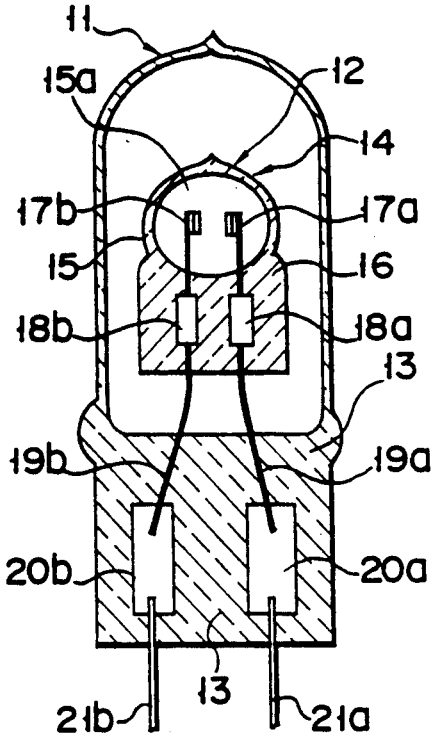
FIG. 2 is a cross-sectional view showing a single end-sealed type miniature metal halide lamp according to an embodiment of the present invention.
Figure 3:
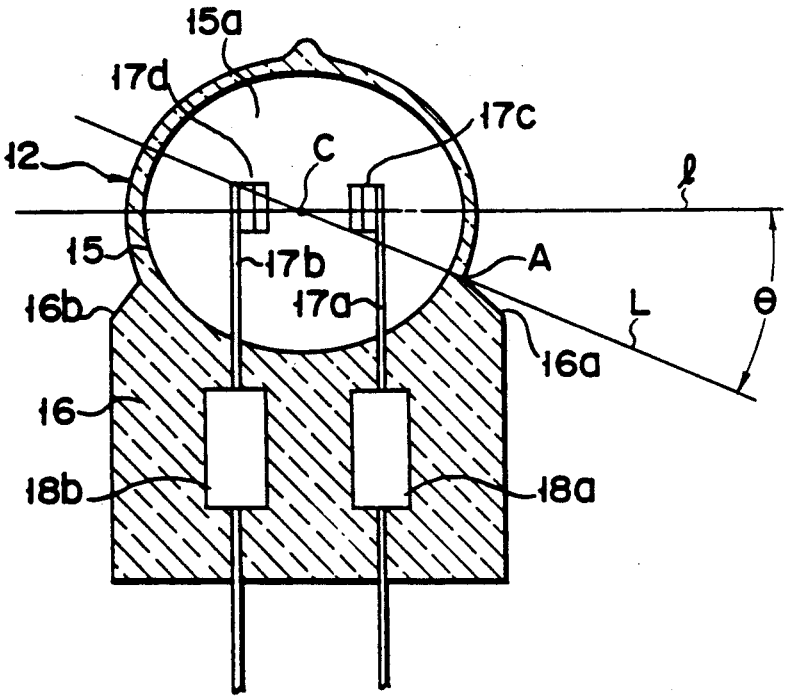
FIG. 3 is a cross-sectional view showing an arc tube of the lamp of FIG. 2.

FIG. 2 is a cross-sectional view showing a 150-W metal halide lamp of the present invention and FIG. 3 is a cross-sectional view showing an arc tube for the metal halide lamp of FIG. 2. In FIG. 2, arc tube 12 is enclosed within outer tube 11 made of quartz glass. A metal base, not shown, is capped on sealing portion 13 which is mounted on one end of outer tube 11.

Arc tube bulb 14 of quartz glass provides an envelope of arc tube 12 and comprises substantially bulblike or elliptical discharge portion 15 defining discharge space 15a and sealing portion 16 which is formed only at one end, the volume of the arc tube bulb being 0.5cc. A pair of electrodes 17a, 17b are provided in discharge space 15a with their tip portions 17c and 17d spaced about 6.5 mm apart from each other. The other end portion of each of electrodes 17a and 17b is sealed into sealing portion 16. Electrodes 17a and 17b are made of a thoriated tungsten wire of, for example, 0.6 mm in diameter with their tip portions 17c and 17d coiled. The other end portions of electrodes 17a and 17b are sealed into sealing portion 16 and connected to metal foils 18a and 18b which are made of, for example, molybdenum and buried into sealing portion 16. Arc tube's lead wires 19a and 19b are connected to metal foils 18a and 18b in sealing portion 16 and extend out from sealing portion 16 into outer tube's sealing portion 13 where lead wires 19a and 19b are connected to metal foils 20a and 20b, respectively. Outer tube's lead wires 21a and 21b are connected to metal foils 20a and 20b, respectively.

Tip portions 17c and 17d of electrodes 17a and 17b may be not only coil-like as set out above, but also linear in configuration. Tip portions 17c and 17d may be formed integral with, or separate from, electrodes 17a and 17b, respectively, In the latter case, tip portions 17c and 17d are welded to electrodes 17a and 17b, respectively.

Arc tube 12 contains a rare gas, mercury and metal halide in predetermined quantities for starting. As the metal halide, use is made of, for example, $SnI_2$, TlI, NaI, LiI, InI, NaBr and LiBr.

Arc tube bulb 14 has such a cross-sectional configuration as to provide a point of inflection, A, at a boundary between discharge portion 15 and sealing portion 16. A straight line l connecting the center of tip portion 17c of electrode 17a to that of tip portion 17d of electrode 17b makes an angle $\theta$ of 35° with respect to a straight line L between the point of inflection, A, and a midpoint C of the line l, noting that shoulder portion 16a of sealing portion 16 is located at a side opposite to that, on which the straight line l exists, with the straight line L as a reference. The same thing is also true of the other shoulder portion (16b).

Upon the lighting of the metal halide lamp as set out above, no temperature drop occurs at the coolest zones (12a, 12b) because less heat is absorbed by shoulder portions 16a and 16b, that is, because those portions 12a and 12b at the discharge portion which are situated behind electrodes 17a and 17b constitute the coolest zones on the inner surface of the arc tube's bulb and are located in the position away from shoulder portions 16a and 16b of sealing portion 16. Furthermore, the heat loss becomes smaller over the whole surface area of sealing portion 16 because the aforementioned angle $\theta$ is as great as 35° and hence the whole surface area of sealing portion 16 is decreased. These two functions serve to prevent a pressure drop in the arc tube and hence to improve the lamp characteristics.

The luminous efficacy of the aforementioned lamp was measured with the varying angle $\theta$, the result of which is tabulated in Table 1.

TABLE 1

| $\theta$(°) | luminous efficacy (λm/W) |
|---|---|
| 45 | 86 |
| 35 | 84 |
| 15 | 80 |

TABLE 1-continued

| $\theta$(°) | luminous efficacy (λm/W) |
|---|---|
| 0 | 72 |

From Table 1 it will be seen that the luminous efficacy is improved with an increasing angle $\theta$, for example, the luminous efficacy becomes higher at $\theta=15°$ than at $\theta=0°$.

At $\theta$ more than 45°, however, it is necessary to decrease the lateral width of sealing portion 16 and, in this case, at the sealing step a molten quartz is moved inward in an increasing quantity so that it is impossible to seal molybdenum foils 18a and 18b at proper position because there is a flow in the molten quartz. That is, it is difficult to ensure an electrode-to-electrode distance necessary for a desired lamp characteristic to be obtained and, in the worst case, it is more liable to produce a short-circuit across molybdenum foils 18a and 18b. It is, therefore necessary that the aforementioned angle $\theta$ be 15° to 45°.

In comparison with the conventional both end-sealed type lamp, the single end-sealed type miniature metal vapor discharge lamp of the present invention is lit at a high lamp load, that is at a severe situation, to enhance the luminous efficacy. That is, the single end-sealed type miniature metal vapor discharge lamp is lit at a high load with WL(watt)/S(cm$^2$)=about 20 to 70 where WL(watt) denotes the input power and S(cm$^2$) the inner surface area of the arc tube. Under such a severe condition, an early blackening occurs in the arc tube, lowering the lumen maintenance factor so that the life of the lamp is decreased.

In the lamp shown in FIGS. 2 and 3, for example, the lamp current I when the lamp is lit at a stable level is 1.8A at which time the lamp's input power W is set to 150W. Since S=3.5 cm$^2$, the lamp load per the unit inner surface area of the arc tube is about 43W/cm$^2$, a value more than twice as high as that of the conventional both end-sealed type metal halide lamp. The reason is that, in order to enhance the luminous efficacy, the tube wall's load is set to be higher than that in the conventional both-end sealed type lamp. This produces the aforementioned drawback.

The inventors have conducted various experiments to improve the lumen maintenance factor and found that the wire diameter of the electrode exerts a greater influence over the lumen maintenance factor.

Generally, with an increasing wire diameter of the electrode the heat capacitor is increased and hence the electrode temperature is lowered, diminishing the scattering of the electrode material onto the tube wall. It is thus possible to lower a "blackening" phenomenon. It is known that, if the wire diameter becomes too great, the electrode temperature is lowered to an excessive extent, so that, for example, the lamp is extinguished or the halogen cycle is adversely affected.

The inventors have conducted experiments on the aforementioned 150W metal halide lamp and examined for a relation of the wire diameter of the electrodes to the lumen maintenance factor after the lamp has been lit in 1000 hours. The result of the experiments is given in Table 2 below.

TABLE 2

| electrode diameter d(mm) | I/d (A/mm) | lumen maintenance factor 1000H/100H (%) | extinguished voltage/rated voltage (%) | evaluation |
|---|---|---|---|---|
| 0.4 | 4.5 | 48 | 72 | bad |
| 0.5 | 3.6 | 62 | 75 | bad |
| 0.55 | 3.27 | 81 | 77 | better |
| 0.65 | 2.77 | 91 | 83 | better |
| 0.75 | 2.40 | 90 | 90 | better |
| 0.8 | 2.25 | 92 | 92 | bad |

If, as shown in Table 2, the wire diameter d of the electrode is set to over 0.55 mm, that is, the lamp current I(ampere)/electrode's wire diameter d(mm) ratio when the lamp is lit at a rated level is set to under 3.27, then the lumen maintenance factor after the lamp has been lit in 1000 hours can be maintained at a practical value of more than 80%.

It is to be noted, however, that the electrode wire diameter d cannot be increased beyond a limit value because the heat capacity of the electrode is increased with an increase in the electrode wire diameter d so that the lamp is liable to go out. Taking the extinguishment of the lamp resulting from a variation in the power source voltage into consideration from a practical viewpoint, it is desired that the value of the extinguished voltage/rated voltage ratio be under 90%. From this it will be necessary that the I/D value be over 2.4.

The aforementioned drawback can be eliminated by setting the I(ampere)/D(mm) ratio when the lamp is lit in a stable level to satisfy the equation:

$$2.4 \leqq I/d \leqq 3.27$$

This equation can be applied not only to a 150W metal halide lamp but also other rated-power lamps.

As set out above, the metal vapor discharge lamp of the present invention can prevent a temperature drop in the coolest zone on the inner surface of the arc tube's bulb whereby pressure prevalent in the arc tube can be maintained at a proper level. It is thus possible to obtain a metal vapor discharge lamp excellent in the lamp characteristics.

By setting the I/d ratio to a predetermined value, in particular, as set out above, the lumen maintenance factor can be enhanced in spite of a load as high as 20 to 70. It is thus possible to improve the life of the lamp.

What is claimed is:

1. A single end-sealed type metal vapor discharge lamp comprising:

an arc tube comprising a bulb including a discharge portion defining a discharge region and a sealing portion having a shoulder portion which is situated adjacent to the discharge portion, and a pair of electrodes being such that they have a pair of mutually opposite electrode portions at one end and that they extend from within the sealing portion toward the discharge region; and an outer tube enclosing the arc tube, in which a cross-sectional configuration of the bulb has a point of inflection at a boundary between the discharge portion and the sealing portion, a straight line l connecting a center of the electrode portion to that of the other electrode portion to that of the other electrode portion makes an angle of 15° to 45° with reslect to a straight line L connecting the point of inflection to a midpoint of the straight line l, and the shoulder portion is located at a side opposite to that, on which the straight line l exists, with the straight line L as a reference;

wherein a value of a WL(wat)/S(cm$^2$) ratio is 20 to 70 and a value of I(ampere)/d(mm) satisfies the following equation:

$$2.4 \leqq I/d \leqq 3.27$$

where WL(watt) is an input power, S(cm$^2$) is an inner surface area of said arc tube, I(ampere) is a lamp current when the lamp is lit at a stable level and d(mm) is a wire diameter of said electrode portions.

2. The lamp according to claim 1, in which said arc tube contains a rare gas, mercury and metal halide.

3. The lamp according to claim 2, in which said metal halide is at least one kind selected from the group consisting of $SnI_2$, TlI, NaI, LiI, InI, NaBr and LiBr.

4. The lamp according to claim 1, in which said electrode portions are coil-like in configuration.

5. The lamp according to claim 1, in which said electrode portions are linear in configuration.

6. The lamp according to claim 1, in which said other end portions of said electrodes are sealed into the sealing portion of said bulb.

7. The lamp according to claim 1, in which a pair of metal foils are buried in said sealing portion, the pair of metal foils are connected to said other ends of said electrodes, a pair of outer tube lead wires are connected at one end to the corresponding metal foils, the other ends of said outer tube lead wires are brought out from said arc tube.

8. The lamp according to claim 1, in which said electrodes and said electrode portions are formed integral with each other.

9. The lamp according to claim 1, in which said electrodes and said electrode portions are separate from each other and are welded to each other.

* * * * *